US008100063B2

(12) United States Patent
Meyers

(10) Patent No.: US 8,100,063 B2
(45) Date of Patent: Jan. 24, 2012

(54) SURFACE EXPANSION MECHANISM

(75) Inventor: David O. Meyers, Kaysville, UT (US)

(73) Assignee: David O Meyers, Kaysville, UT (US)

( * ) Notice: Subject to any disclaimer, the term of this patent is extended or adjusted under 35 U.S.C. 154(b) by 228 days.

(21) Appl. No.: 12/365,898

(22) Filed: Feb. 5, 2009

(65) Prior Publication Data

US 2009/0223423 A1 Sep. 10, 2009

Related U.S. Application Data

(60) Provisional application No. 61/063,753, filed on Feb. 5, 2008.

(51) Int. Cl.
*A47B 1/04* (2006.01)

(52) U.S. Cl. ..... 108/73; 108/76

(58) Field of Classification Search ..... 108/73, 108/76, 71, 69, 74, 89, 70, 84, 86
See application file for complete search history.

(56) References Cited

U.S. PATENT DOCUMENTS

| | | | | | |
|---|---|---|---|---|---|
| 83,460 | A | | 10/1868 | Carroll | |
| 522,101 | A | * | 6/1894 | Bohr | 108/76 |
| 1,210,381 | A | | 12/1916 | Moore | |
| 1,270,458 | A | | 6/1918 | Syred | |
| 1,464,409 | A | | 8/1923 | Cooklin | |
| 1,532,715 | A | | 4/1925 | Petrarca | |
| 1,861,565 | A | | 6/1932 | Hall | |
| 1,875,295 | A | * | 8/1932 | Fox | 108/76 |
| 1,915,347 | A | | 6/1933 | Wurm | |
| 1,938,223 | A | * | 12/1933 | Knaub et al. | 108/73 |
| 1,938,893 | A | * | 12/1933 | Cooper | 108/73 |
| 1,994,538 | A | * | 3/1935 | Segal | 108/73 |
| 2,017,760 | A | * | 10/1935 | Lanum | 108/73 |
| 2,102,449 | A | * | 12/1937 | Zimmerman | 108/84 |
| 2,187,133 | A | * | 1/1940 | Luppert | 108/73 |
| 2,205,274 | A | | 6/1940 | Rastetter | |
| 2,240,551 | A | | 5/1941 | Cooper | |
| 2,456,835 | A | * | 12/1948 | Nash | 108/76 |
| 2,463,911 | A | * | 3/1949 | Sacks | 108/73 |
| 2,657,108 | A | | 10/1953 | Leblanc | |
| 3,504,642 | A | | 4/1970 | Kovach | |
| 3,648,628 | A | | 3/1972 | Davis | |
| 3,769,919 | A | | 11/1973 | Thomas | |
| 3,974,782 | A | | 8/1976 | Ruckriegel | |
| 4,020,771 | A | | 5/1977 | Hasenour | |
| 4,061,091 | A | | 12/1977 | Goyvaerts | |
| 4,077,335 | A | | 3/1978 | Luzzani | |
| 4,297,952 | A | | 11/1981 | Zagaroli | |
| 4,344,369 | A | | 8/1982 | Van Noord | |
| 5,207,162 | A | | 5/1993 | Mismas | |
| 5,237,937 | A | | 8/1993 | Peltier | |
| 6,038,985 | A | | 3/2000 | Chang | |
| D437,714 | S | | 2/2001 | Rasche | |
| 6,742,461 | B1 | | 6/2004 | Sen | |
| 6,994,032 | B2 | | 2/2006 | Conley | |
| D525,806 | S | | 8/2006 | Lai | |
| 2004/0194672 | A1 | | 10/2004 | Conley | |
| 2006/0124037 | A1 | | 6/2006 | Conley | |
| 2007/0289505 | A1 | * | 12/2007 | Turenne | 108/73 |

* cited by examiner

*Primary Examiner* — Jose V Chen

(57) ABSTRACT

A mechanism and method for storing and deploying an expansion portion of a surface is provided. The mechanism is configured so as to raise and lower a storable expansion surface portion with respect to an adjacent surface portion, allowing the storable expansion surface portion to be stored behind the adjacent surface portion when a smaller surface area is desired.

3 Claims, 7 Drawing Sheets

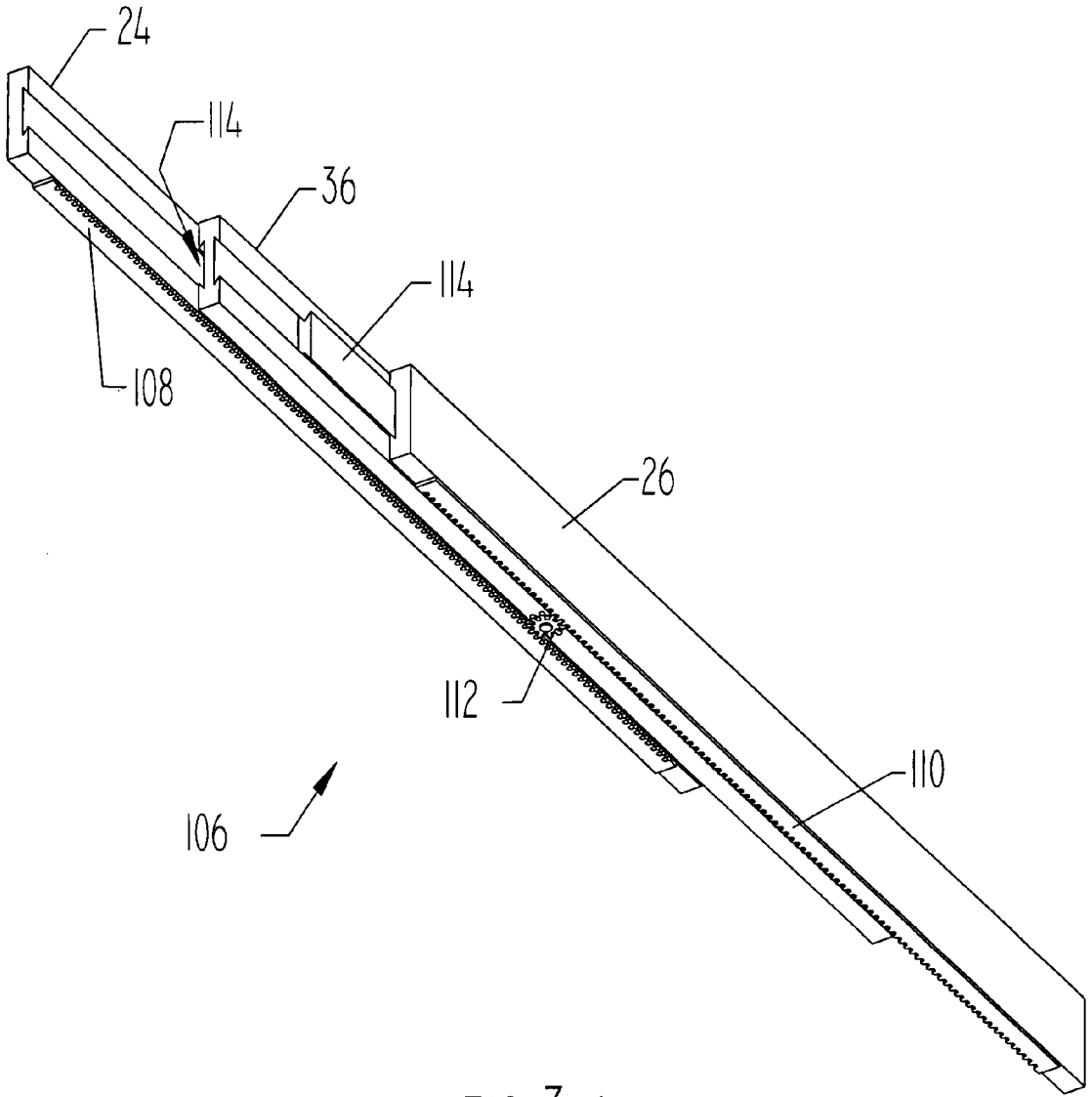
FIG 3-A

FIG 5-A
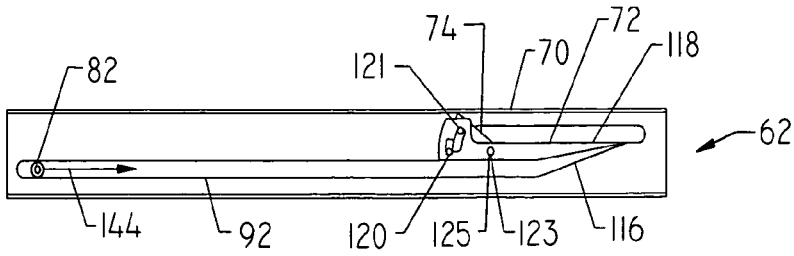
FIG 5-B
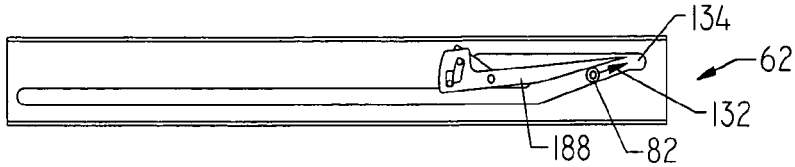
FIG 5-C
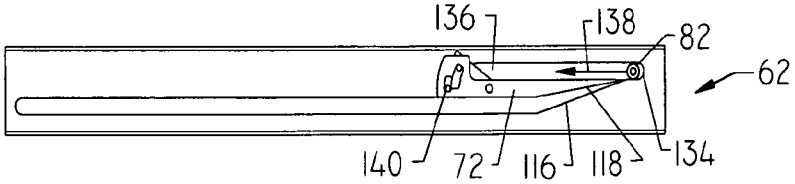
FIG 5-D
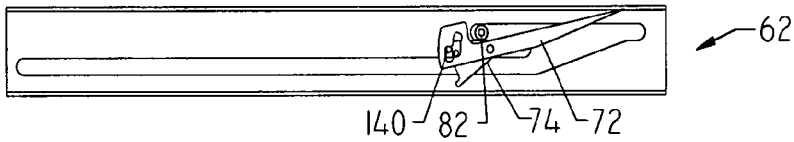
FIG 5-E
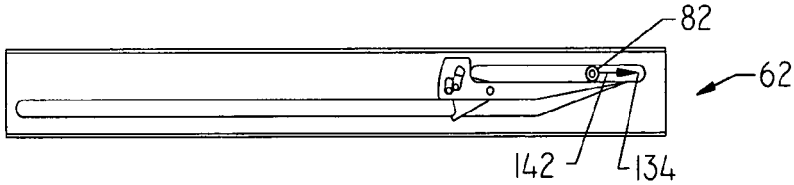
FIG 5-F
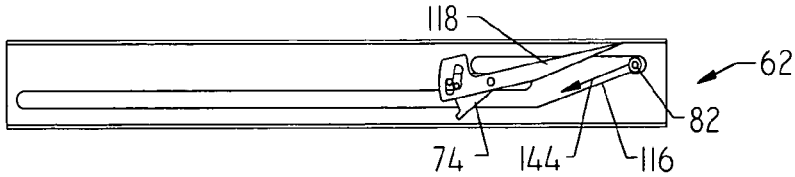
FIG 5-G
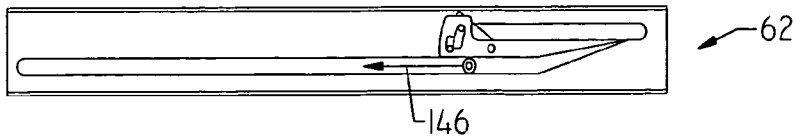

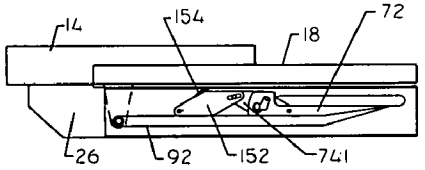
FIG 7-A
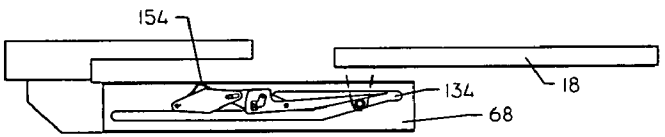
FIG 7-B
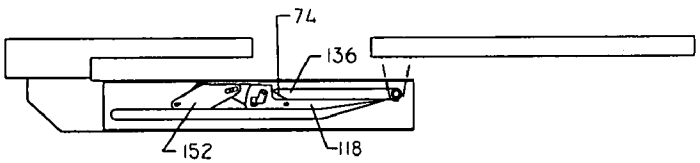
FIG 7-C
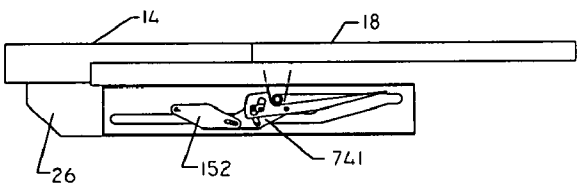
FIG 7-D
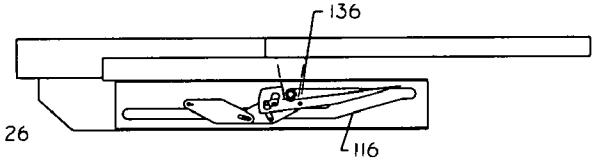
FIG 7-E
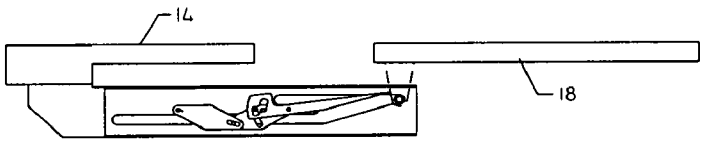
FIG 7-F
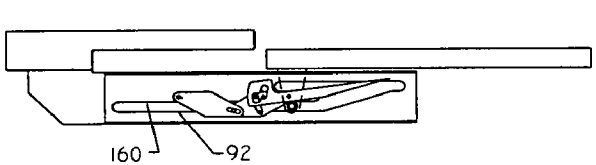
FIG 7-G
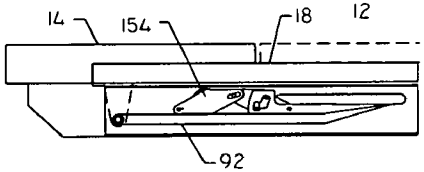
FIG 7-H

SURFACE EXPANSION MECHANISM

FIELD OF THE INVENTION

The present invention relates to a mechanism for mechanically expanding surface areas.

BACKGROUND OF THE INVENTION

The invention relates to making surfaces expandable—such as tabletops, whiteboards and blackboards, counters, podiums, platforms, and the like, where it is desired to have a plurality of surface area sizes and ease of change between smaller and lager surface areas is desirable. For purposes of example only, and not by way of limitation, the invention will be described in connection with one application, specifically: a table top. However the invention is applicable more broadly.

SUMMARY OF THE INVENTION

The mechanism is configured so as to raise and lower a storable expansion surface portion with respect to an adjacent surface portion, allowing the storable expansion surface portion to be stored behind the adjacent surface portion when a smaller surface area is desired; and which brings the expansion surface portion forward so as to be coplanar with the adjacent surface portion when the adjacent surface portion is moved laterally outward, and allow the expansion surface portion and the adjacent surface portion to be positioned contiguously, thus enlarging the surface area by the area of the expansion surface area when desired. In one example, two adjacent surface portions which can be provided, comprising table surface portions at least one of which can be moved laterally, and the storable expansion portion can be moved forward into a use position coplanar with them, thus acting to add an extra table leaf in the center of the table. When at least one of the adjacent surface areas is moved inwardly, the storable expansion surface portion moves rearward to a storage position behind the adjacent surface portions. In one example this mechanism allows at least one of the adjacent surface portions to be moved into and out of position contiguous with the storable expansion surface portion when it is in the use position. This motion either creates a detent effect to hold said at least one adjacent surface in position contiguous with the storable expansion surface portion when the adjacent surface is moved toward the storable expansion surface portion while it is in the use position, or to reorder the mechanism to retract the storable expansion surface portion when the adjacent surface portion is moved outward away from said position contiguous with and beside the storable expansion portion in the use position. In the latter case when the adjacent surface portion is thereafter moved toward the storable expansion surface portion the storable expansion surface portion moves rearward with respect to the adjacent surface portions to a storage position behind them. This allows at least one of the adjacent surface portions to close over the storable expansion surface portion and move to a position coplanar with, and contiguous to, the other adjacent surface portion, thus shrinking the surface area by the area of the storable expansion surface portion.

The above-described features and advantages of the present invention, as well as additional features and advantages, will be set forth or will become more fully apparent in the description that follows. Furthermore, the features and advantages of the invention may be learned by the practice of the invention, or will be obvious to one skilled in the art after referring to the invention description, as set forth hereinafter.

BRIEF DESCRIPTION OF THE DRAWINGS

Various embodiments of the present invention are shown and described in reference to the numbered drawing wherein:

FIG. 3A is a more detailed bottom left isometric view of a rack and pinion system for expanding/contracting the surface area of the table by moving one of two adjacent table surface area end elements;

FIG. 5*a-g* is a series of elevational views of the relevant portions of the surface expansion mechanism with the order of elements altered for clarity of presentation (the reversing lever is shown behind the gate/guide/bridge element when it would actually be in front in the view), showing the interplay of the elements thereof in operation in expanding and contracting the surface area of the table via opening and closing the adjacent surface area table end elements, causing the storable expansion surface area table leaf portion to be raised and lowered, and more particularly showing the operation of a gate/guide bridge element in directing the path of an idler attached to the storable expansion surface table leaf portion just mentioned in raising and lowering same as the adjacent surface area table end portions are moved inward and outward in the illustrated example embodiment;

FIG. 7*a-h* is a series of elevational views, analogous to those of FIG. 5*a-g* showing operation of the second example embodiment shown in FIG. 7.

It will be appreciated that the drawings are illustrative and not limiting of the scope of the invention which is defined by the appended claims. Further, like reference numbers refer to like (but not necessarily identical) elements throughout the figures and the example(s) and variations thereof illustrated in the figures. The embodiments shown accomplish various aspects and objects of the invention.

DETAILED DESCRIPTION OF THE INVENTION

Figure 1:
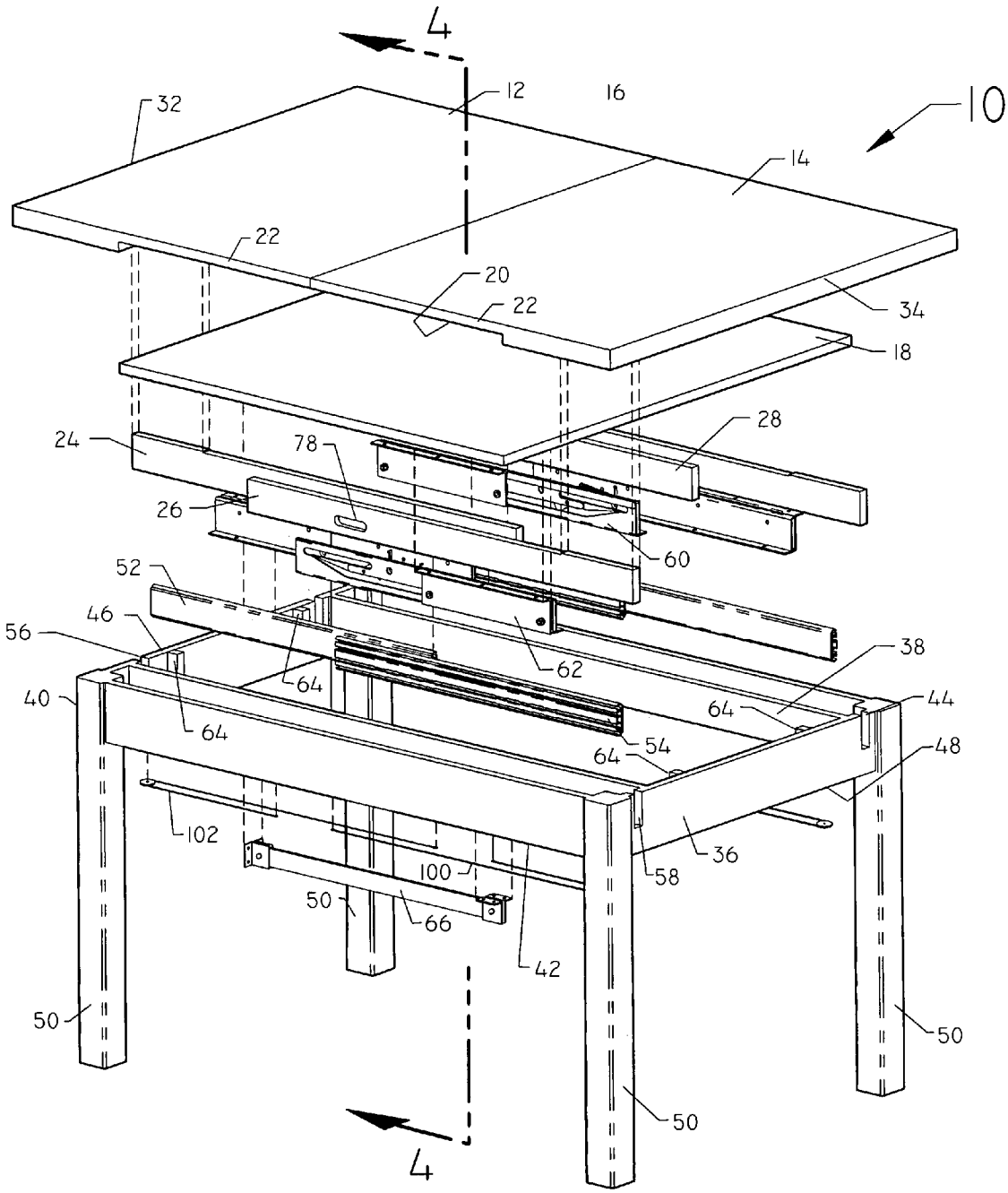
FIG. 1 is an exploded view of an embodiment in an expandable table, certain details being excluded for clarity of presentation, i.e. certain elements on the far side of the table in the figure are omitted for sake of clarity, being mirror image identical in nature and position to elements shown on the near side, as well as pulleys and related structure pertinent to expanding the table top being omitted (it is shown in FIG. 3), details of the mechanism shown in other figures are also omitted here in order to present the overall scheme more clearly.

With reference more particularly to FIG. 1, in the example embodiment shown a table 10 includes adjacent surface portion table end elements 12, 14 together defining a top surface 16 of the table of a first, smaller, size area. A storable expansion leaf surface portion element 18 is shown in a first, storage, position underneath the adjacent surface portion table end elements. It fits into a space 20 defined by a decreased thickness portion 22 of each of the two adjacent surface portion table end elements. Table end support arms 24, 26, 28, 30 are attached to the adjacent surface portion table end elements near their outward edges 32, 34, and are positioned below the space 20 occupied by the storable expansion leaf surface portion element. The table end support arms are attached to inner rails 36, 38 of a table support structure 40 in a manner described below. The support structure also includes outer rails 42, 44, notched, end rails 46, 48 and table legs 50. The discussion will now be addressed to one side of the table (the near side) where more elements are shown. Many elements on the far side of the table in the drawing have been omitted (hidden behind other structure in the exploded view) for clarity of presentation of the overall configuration, as mentioned above.

The table end support arms 24, 26 are attached to inner and outer sides of the inner rail 36 via liner glides (or slides) 52, 54, respectively. They move through slots 56, 58 in the end rail elements 46, 48 when the adjacent surface portion table end elements 12, 14 are slid apart in expanding the table. The storable expansion leaf surface portion 18 is attached to the near side inner rail 36 of the support structure 40 in the figure via two expansion mechanisms 60, 62 as will be further described below, which are in turn attached to the support arms 24, 26, which are themselves in turn slidably attached via the liner glides 52, 54 to the inner rail as just described. This can be further appreciated with reference to FIG. 4 as well as FIG. 1. In one embodiments guide blocks 64 carried by the end rails 46, 48 can be provided to guide the movement of the storable expansion leaf surface portion and hold it in place centered over the support structure in the illustrated example. In another embodiment a expansion leaf centering arm 66 can be pivotably provided between the storable expansion leaf surface portion 18 and the support structure 40 to restrain sideways movement of said portion 18 while allowing vertical motion thereof.

Figure 2:
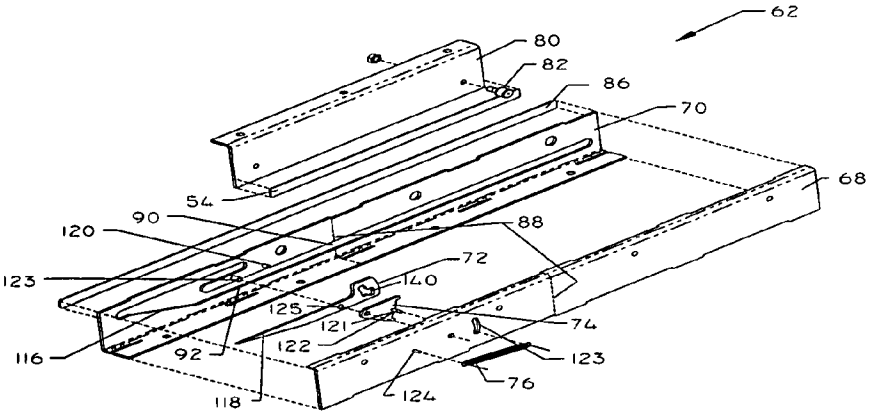
FIG. 2 is a more detailed exploded view of a surface expansion mechanism portion in one example embodiment.

With reference to FIG. 2 and to FIG. 1, the expansion mechanism 60, 62 is in each case configured to bring the storable expansion leaf surface portion 18 forward to be coplanar with the adjacent surface portion table end elements 12, 14 when expanding the top surface of the table 10; and to bring it back to a first storage position when collapsing the table example embodiment surface back down to a smaller size. The two mechanisms are disposed in orientation 180 degrees from each other, so as to function essentially identically when the adjacent table end surface elements 12, 14 are moving in opposite directions at the same time. Like arrangements are provided at the far side of the table illustrated adjacent expansion table end support arms 28, 30, and again description of the near side does for those like arrangements at the far side as they are essentially identical.

With particular reference to FIG. 2, an expansion mechanism 62 inner housing element 68 is rigidly mated to an outer housing element 70 with a gate/guide bridge element 72 and reversing lever element 74 pivotably disposed therebetween. This rigid mating can be by riveting, welding, fasteners, etc. In the illustrated embodiment the inner housing element is attached to a table end support arm 26. A reverse lever spring 76, which acts to bias the reverse lever to each of two positions in reversing movement of the bridge element, as will be described, is disposed between the inner housing element and the support arm (26 in FIG. 1) in a cavity (78 in FIG. 1) formed in the support arm. A bracket 80 rotatably carrying an idler 82, for example via a bearing (conventional not shown) is coupled to the storable expansion leaf surface portion (18 in FIG. 1), and is positioned adjacent the outer housing element, and can be in contact therewith via glides 84, 86 formed of a lubricous material, such as Teflon for example, attached to the bracket and outer housing element, respectively. In one example embodiment the expansion mechanism can be cut off as shown by a line 88 (outline) and this embodiment allows relative travel of any length between the support arm 26 and the rest of the table—allowing the mechanism to be used with multiple sizes of tables. When using a shortened version, more stiffness in the outer housing bracket element 70 may be required as a slot 92 therein then has an open end, making bending under certain conditions an increased possibility to be mitigated. Inclined guiding portions 90 defined by the outer bracket in this example guide the idler 82 into the slot 92 in the outer housing element in operation, as will be described hereafter.

Figure 4:
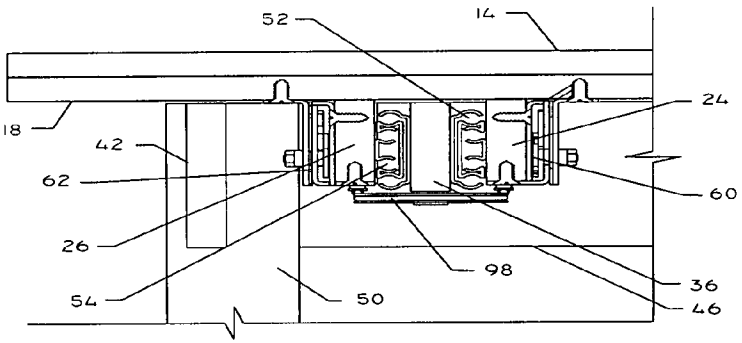
FIG. 4 is a cross-sectional view, taken along line 4-4 in FIG. 1 of the illustrated elements in unexploded configuration.
Figure 3:
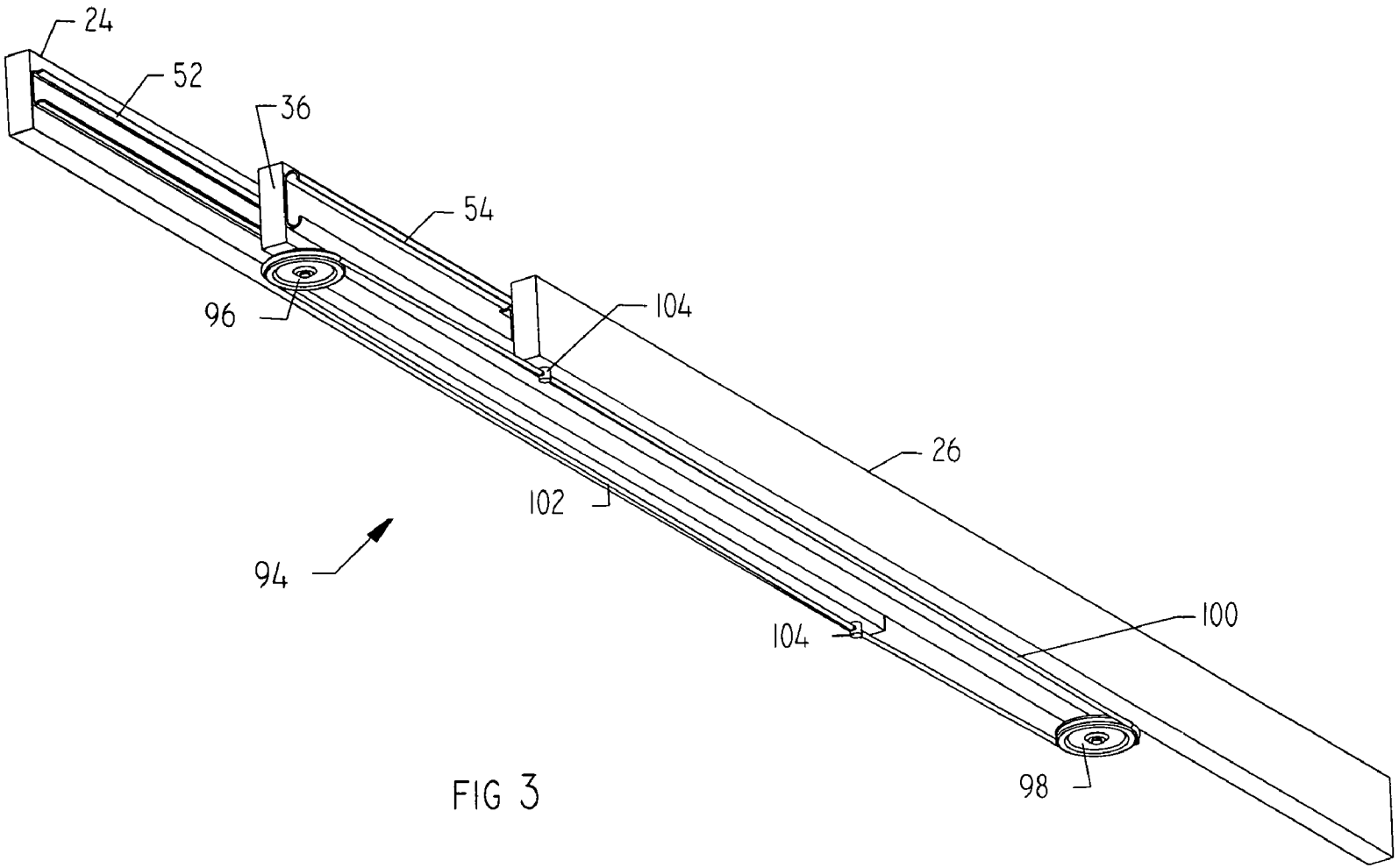
FIG. 3 is a more detailed bottom left isometric view of a pulley system for expanding/contracting the surface area of the table by moving one of two adjacent table surface area end elements.

With reference to FIGS. 1, 3 and 4, the means for causing the adjacent surface portion table end elements 12, 14 to move in opposite directions to each other in a coordinated manner in one example embodiment can be appreciated. A system 94 of pulleys 96, 98 and cables 100, 102 connect said elements via the end support arms 24, 26. The pulleys are mounted on the stationary inner rail 36 of the support structure 40. Cable tie elements 104 fix the cables to the support arms so that when one arm moves, the other must move also, the same amount and in the opposite direction, as the cables move around the pulleys requiring this—and essentially no other movement—of one arm 24 with respect to the other 26. Other means for providing this relative movement can be provided. For example with reference to FIG. 3*a* a rack and pinion system 106 can be used including gear racks 108, 110 coupled to the support arms 24, 26 and a pinion gear 112 rotatably coupled to the inner support rail 36. Note also that instead of the liner glides (52, 54 in FIG. 3) a conventional tongue and grove slide arrangement 114 can be used in the example table 10 embodiment in providing the described relative movement.

With reference to FIG. 2 and to FIG. 5(*a*-*g*) operation of the expansion mechanism 62 will now be further described with more particularity. When the table 10 is in the smaller table surface area (collapsed) configuration shown in FIG. 1 the idler 82 is positioned as shown in FIG. 5*a*. As the table is expanded by pulling out the adjacent surface area table end elements (12, 14 in FIG. 1), the idler moves in the direction of the arrow 111 in the slot 92 defined by the outer bracket 70 toward an inclined portion 116 of the slot. The gate/guide bridge element 72 is disposed in an initial, or bridging position with a narrowed gate/guide portion 118 disposed across the inclined portion of the slot and resting against a stop pin 120 carried by the outer housing element 70. The reversing lever 74 urges the bridge element to this position via a bridge element engaging pin 121 which extends toward and engages the bridge element. A spring engaging pin 122 extends out on the opposite side through the inner housing bracket member 68 through a slot 123 defining the limits of movement of said pin 122 and the reversing lever through which it passes. The reversing lever in turn is under the biasing influence of the reverse lever spring 76 disposed between an anchor pin 124 and the spring engaging pin 122. This arrangement provides a two-position over-center functionality for the reverse lever, pivoting back and forth over a pivot pin element 123 which extends from the outer housing bracket element 70 through a pivot hole 125 in the bridge element 72 and like pivot hole 125 in the reversing lever to engage in a hole or recess in the inner housing element 68. One position of the two positions of the over center arrangement is occupied when the mechanism is in this initial configuration, one where the lever element is "up" in the view(s).

In the next FIG. (5*b*) the mechanism 62 has moved sufficiently with respect to the storable expansion leaf surface bracket 80 that the idler 82 is on the inclined or ramp portion 116 of the slot 92. At this point the adjacent surface area table end elements (12, 14 in FIG. 1) are moved aside sufficiently, and as the outer bracket passes by the idler, leaf bracket 80 and the storable expansion surface table leaf element 18 connected thereto urged upward by the ramping action of the idler on the inclined portion of the slot and is rising towards its deployed position coplanar with the adjacent surface area table end elements. The gate/guide/bridge element is tipping—against the bias of the reverse lever spring 76—upward sufficiently to allow the idler to pass underneath it; however it will not tip sufficiently to trip over-center the position of the lever element 72 by reason of the idler passing underneath the narrowed guide portion 118 of the bridge element. Thus the biasing force on the gate/guide/bridge element remains that which tends to tip the narrowed portion 118 downward as the idler passes out from under it as shown by the arrow 132 into a short level continuation portion 134 of the slot. The end of movement of the idler in this direction 132 stops outward movement of the adjacent surface table end element(s).

With reference now to FIG. 5*c* the guide/gate bridge element 72 flips back to its original position after the idler 82 passes under the narrowed gate/guide portion 118. It thus forms a "bridge" across the inclined (ramp) portion 116 of the slot 92; the bridge connecting the short level continuation portion 134 of the slot with a shelf portion 136 which supports the storable expansion surface table leaf element in the deployed position coplanar with the adjacent surface table end elements. Pushing the adjacent surface table end element (s) back towards the now deployed storable expansion surface table leaf element moves the outer housing 70 relative to the idler so that the idler moves across the "bridge" in the direction shown by the arrow 138 until the table surface is contiguous as the elements all are pushed against each other. The shelf portion now can support the leaf element and things placed thereon.

Turning to FIG. 5*d* at the same time the adjacent surface table end elements 12, 14 are approaching contact with the storable expansion surface table leaf element 18, the idler is approaching the end of the shelf portion and contacting the reversing lever 74 which covers part of the shelf portion of the slot, pushes the reversing lever downward over-center to its other (down) position shown. This also forces the gate/guide bridge element to tip up to the position shown. This acts to bias the idler to the position at the end of the shelf portion shown in the figure. This is the position at which the table is at the deployed expanded position with the table surface expanded and its elements contiguous. The mechanism thus has a detent functionality holding the table in this configuration during use. The detent must be overcome for the tabletop elements (12, 14, 18) to separate preparatory to shrinking of the table top surface area and storage of the leaf portion. Note that the limits of movement of the bridge element 72 are established by an opening 140 through which the pins 120, 121 described above pass. Pin 120 prevents further upward tipping of the narrowed gate portion 118, and pin 122 requires that the reversing lever move against the biasing force of the reversing spring 76 in order to allow the gate portion of the element to move back down, providing the detent function just mentioned.

With reference to the next figure in the series (5*e*) to close the table 10 the ends 12, 14 are moved outward by pulling one of them out, overcoming the detent bias and moving the idler 82 back over the "bridge" of the guide/gate bridge element 72 thus tipped down by the idler rolling over it. Note that the bridge element is now biased to tip up, which it will when the idler moves in the direction shown by the arrow 142 onto the short level continuation portion 134 of the slot 92. This allows the gate/guide bridge element to pivot back up, which it then does—as shown by the next figure (FIG. 5*f*). This stops outward movement of the table end(s), and the user then pushes the table end being manipulated back toward the extension leaf element 18 in the center of the table 10 to close the table and store said element 18. The inclined portion 116 of the slot and the narrowed gate/guide portion 118 of the bridge element 72 now urge the idler downward (lowering the leaf) in movement of the idler being downward, but strictly from the reference frame of the mechanism relative movement of the idler is in the direction of the arrow 144 shown.

With reference to FIG. 5*g* when the idler moves off the inclined (ramp) portion 116 of the slot 92 and moves along the slot in relevant movement to the housing bracket member 70 in the direction shown by the arrow 146 it contacts the reversing lever 74 (which is still biased to the down position by the reversing spring) which covers part of the slot. The idler moving past the reversing lever moves it upward, over-center, back to the first position, in turn also tipping the gate/guide bridge element to tip back down to its original position (ready for the next cycle) and now biased to that original position by the reversing lever engagement pin 121 as before described. Thus, the whole process is accomplished by moving the table end(s) 12, 14 out and back to deploy, and again out and back to store, the storable expansion table leaf element 18. This is done with relative ease and, to a user, intuitive simplicity, heretofore unknown in the art at the time of filing this disclosure.

Figure 6:
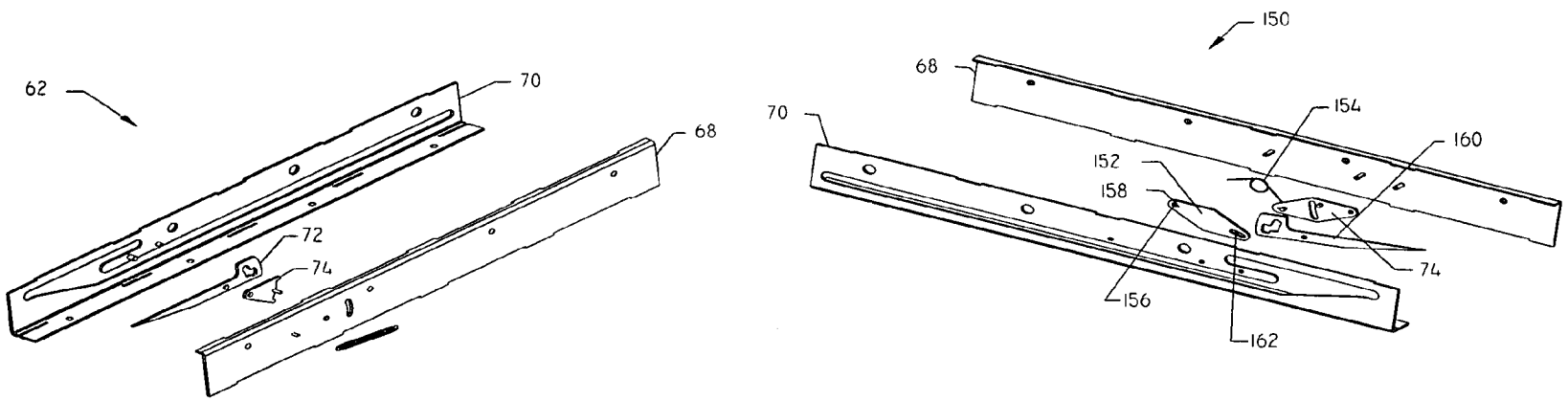
FIG. 6 is a side-by side comparison exploded view of two example variations of the illustrated embodiment mechanism example.

Turning to FIG. 6, another example embodiment of the expansion mechanism 150 shown side-by-side with that 62 just described has the relative advantage of the elements being positionable internal to, and in-between the inner bracket housing element 68 and the outer bracket housing element 70. The mechanism functions essentially the same as before described, but there are a few differences. The reversing lever 74' (74 prime) of this other example embodiment is diamond shaped and is over-center biased by a (coincidentally also essentially diamond shaped) over-center cam plate 152 and biasing spring 154. The spring engages at one end with the cam plate by hooking in a small spring engagement hole 156 adjacent a larger pivot pin hole 158 and at the other end through a spring engagement hole 160 in the reversing lever element 74' into a slot 162 in the other end of the cam plate. The slot allows the spring to compress and expand as the cam plate and reversing lever over-center between two positions (up and down) for the reversing lever as described above. Note that the cam plate also covers part of the slot 92 in the outer housing 70, and thus can correct a miss-positioning of the rest of the elements of the expansion mechanism with respect to the idler 82 position, should it occur. This will be further appreciated with reference to FIGS. 7*a-h*, analogous to FIGS. 5*a-g*, showing operation of the mechanism.

FIGS. 7*a-d* are directly analogous to FIGS. 5*a-d*, and the same description of operation applies, with the exception that the function of the reverse lever spring (76 in FIG. 2) is taken by the diamond shaped over-center cam plate 152 and biasing spring 154. FIG. 7*c* is the same as FIG. 7*d*, except that the intention is now to collapse the table 10, rather than use it. In other words the end position for deployment is the beginning position for storage. The adjacent surface area table end element 14 is then pulled outward until the idler 82 is at the stop provided by the short level continuation 134 of the slot. This is shown at FIG. 7*f*, which is directly analogous to FIG. 5*f*, with its accompanying description. In FIG. 7*g*, the idler 82 is just beginning to move the reversing lever 74' upward off the lower position and over-center towards the upper position, where it rests as shown in FIG. 7*h*—as the table end element 14 moves inward to its initial closed position shown therein. With reference to FIG. 7*g* it can be appreciated that (as mentioned above) should the idler accidentally get into the position 160 in the channel 92 and the reversing lever element (and diamond shaped cam plate 152) are in the lower position, pulling the table end 14 out will move the cam plate and idler with respect to each other so as to reset the mechanism to the initial configuration shown in FIG. 7*a*, which is also the ending position shown in FIG. 7*h*.

From the foregoing it will be appreciated that the invention provides the ability to easily and intuitively deploy and store an expansion surface portion from behind at least one adjacent surface portion to expand and contract the area of a surface to be used. Moreover, this functionality can be provided at reasonable cost in a mechanism that can be employed in useful articles as shown by the illustrated example(s) shown and described herein.

The invention claimed is:

1. A surface expansion mechanism comprising:

an element moving relative to a slot, said slot having a retraction path and an expansion path, to move a storable expansion surface portion from a storage position to a position essentially coplanar with at least one adjacent surface portion when said adjacent surface portion(s) is/are moved in a lateral direction relative to the surface, and reversibly move it back to the storage position;

a gate element changing the available paths of the element in the slot depending on relative movement in expanding or shrinking the size of the surface by deploying or storing the expansion surface portion adjacent or behind the said at least one adjacent surface portion; and a reversing element that alters the position of the gate element depending on the location of the element moving relative to the slot, said reversing element being operably configured between a refraction position and an expansion position through a force-induced bias wherein the element moving in the slot will move the reversing element into the retraction position when the element traverses the expansion path and into the expansion position when the element traverses the retraction path.

2. The surface expansion mechanism of claim 1, wherein the reversing element further comprises a reverse lever spring disposed between an anchor pin and a spring engaging pin wherein the reversing element can pivot back and forth between the retraction and expansion positions.

3. The surface expansion mechanism of claim 1, wherein the reversing element is operably connected with the gate element such that when the reversing element is in the retraction position the gate element is biased into a detent position whereby the element moving in the slot is initially restricted by the gate element from reverse movement along the retraction path.

* * * * *